US005574412A

United States Patent [19]

Nilsson

[11] Patent Number: 5,574,412

[45] Date of Patent: Nov. 12, 1996

[54] MAGIC T AND A COMPARATOR COMPRISING A PLURALITY OF MAGIC TS

[75] Inventor: Gunnar L. Nilsson, Kungsbacka, Sweden

[73] Assignee: Telefonaktiebolaget LM Ericsson, Stockholm, Sweden

[21] Appl. No.: 384,332

[22] Filed: Feb. 1, 1995

[30] Foreign Application Priority Data

Feb. 2, 1994 [SE] Sweden ..... 9400318

[51] Int. Cl.[6] ..... H01P 5/20

[52] U.S. Cl. ..... 333/122; 333/137

[58] Field of Search ..... 333/121, 122, 333/125, 137

[56] References Cited

U.S. PATENT DOCUMENTS

| | | | |
|---|---|---|---|
| 2,973,487 | 2/1961 | Hanson et al. . | |
| 2,981,948 | 4/1961 | Kurtz . | |
| 3,670,268 | 6/1972 | Connerney | 333/122 |
| 3,918,011 | 11/1975 | Salzberg | 333/122 |
| 3,931,599 | 1/1976 | Salzberg | 333/121 X |
| 4,174,507 | 11/1979 | Young | 333/122 |
| 4,720,691 | 1/1988 | Rammos | 333/122 |

OTHER PUBLICATIONS

S. Cornbleet, "Monopulse Combining Network", *Electronics Letters*, vol. 1, No. 6, Aug. 1965, p. 158.

*Primary Examiner*—Paul Gensler
*Attorney, Agent, or Firm*—Burns, Doane, Swecker & Mathis, LLP

[57] ABSTRACT

A device for generating signals by bringing four input signals in the microwave range together, which signals are the sum and differences between various combinations of the input signals, has waveguides arranged in a first and a second parallel plane, located next to each other. The waveguides of the first plane have parallel input ports to a first and a second magic T in which the four input signals are added in pairs, as well as waveguides by which the input signals added in pairs are supplied to the input ports of a third magic T where they are added to generate a first output signal, and subtracted to generate a second output signal. In the first and second magic T the four input signals are subtracted in pairs. The input signals subtracted in pairs are transferred to waveguides in the second plane by which they are supplied to a fourth magic T arranged in the second plane. In this magic T the signals are added, and a third output signal is generated.

11 Claims, 1 Drawing Sheet

MAGIC T AND A COMPARATOR COMPRISING A PLURALITY OF MAGIC TS

BACKGROUND

The present invention relates to a device for bringing signals in the microwave range together.

Within the technical areas of satellite communication, target tracking radar and the like there are demands for an accurate alignment of high-directivity antenna systems. For perfect transmission quality when receiving signals from a satellite it is therefore important that the receiving antenna is directed towards the satellite at all times. It is also of great importance that an antenna of a target tracking radar is directed towards the target since this makes it possible to determine the position of the target with high accuracy.

An often used technique for determining the direction of an antenna system in relationship to the direction of the received signal is that the antenna system is equipped with four reception elements that are horizontally and vertically symmetrically placed around the main direction of the antenna system. By combining the received signals from the four antenna elements in a suitable way, signals can be formed which indicate the difference between the direction of the antenna system and the direction of the received signal. The signals can then be used for alignment of the antenna system. This technique is often referred to as the mono pulse system.

As an example it can be mentioned that if the signals received by the four antenna elements are referred to as A, B, C and D then difference signals of the form (A+B)–(C+D) and (A+D)–(B+C) can be suitably formed. It is also common to form the information carrying summation signal (A+B+C+D).

The frequencies used in the mentioned applications imply that wave-guides are used for signal transfer. When forming the difference and summation signals it is therefore suitable to use a component that usually goes under the name of "magic T". This component has the characteristics that when it is fed with two signals it forms both the sum of the signals, as well as the difference between them. The conventional magic T has both its inputs and one of the outputs placed in the same plane (but aimed in different directions) while the other output (the difference output) is perpendicular to the plane.

To be able to form the above-mentioned difference and summation signals in a comparator, one has to combine four magic T:s. Due to the geometrical form of the conventional magic T, the connection of the T:s becomes complicated with wave-guides, -knees, -bends etc. Due to this the devices become bulky and difficult to manufacture. The multitude of variations of the mechanical design is rather limited since there is also a constraint of equality regarding electrical "wave length" through the different branches of the comparator.

The conventional design of the magic T has therefore aquired imitations with different designs that are able to fit into more compact constructions. The American patent U.S. Pat. No. 3,918,011 is an example of such a construction. The patent describes a magic T where the two inputs are placed in parallel next to each other in one plane and where the two outputs are placed in the opposite direction and perpendicular to the input plane. This has been made possible by integrating a knee and impedance matching in the structure of the T.

The American patent U.S. Pat. No. 4,174,507 is another example of a magic T of a "low" design. The patent describes a conventional magic T where the perpendicular wave-guide from the difference output from the T is replaced with a wave-guide that is parallel to the inputs and the plane of the summation output. To match the wave-guide to the difference output, the wave-guide is placed so that a short circuited stub is formed, as well as a number of impedance matched devices being placed in the wave-guide and the T.

The currently known versions of the conventional T have, among other things, in common that they require relatively substantial devices for impedance matching. Nor are they directly adapted to be connected together in compact comparator devices.

SUMMARY

The object of the present invention is thus to provide a comparator that requires little space and by a special design of the incorporated magical T:s becomes compact and easy to manufacture without the need to use special impedance matching devices- The design of the comparator is further such that it is easier to fulfill the requirements of equal wave length through the different branches of the comparator.

Said object is achieved by means of a device according to the present invention, the characterizing features of which will become apparent from reading this description.

DETAILED DESCRIPTION

The invention shall be described in the following in the form of an example of an embodiment and with reference to FIGS. 1 and 2.

Figure 1:
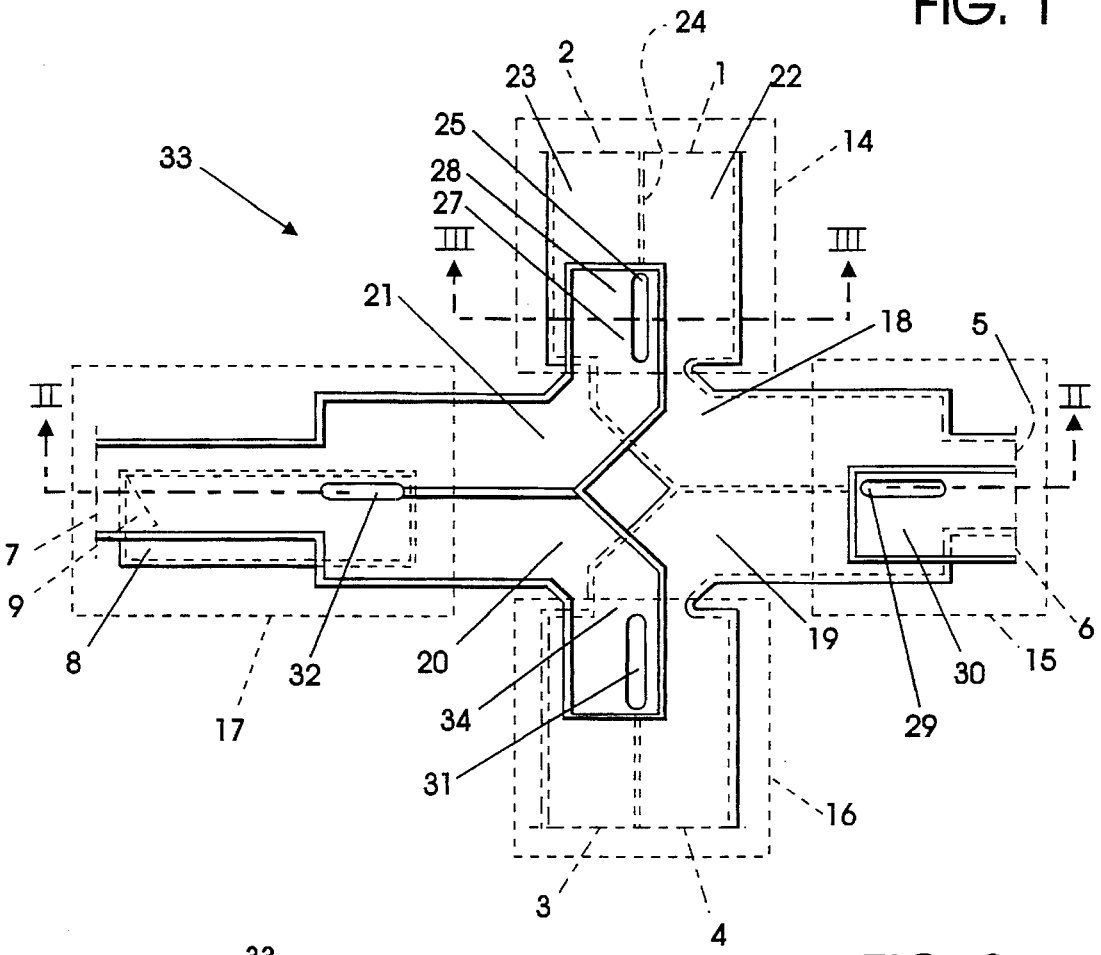
FIG. 1 shows a plan view of a preferred embodiment the invention.
Figure 2:
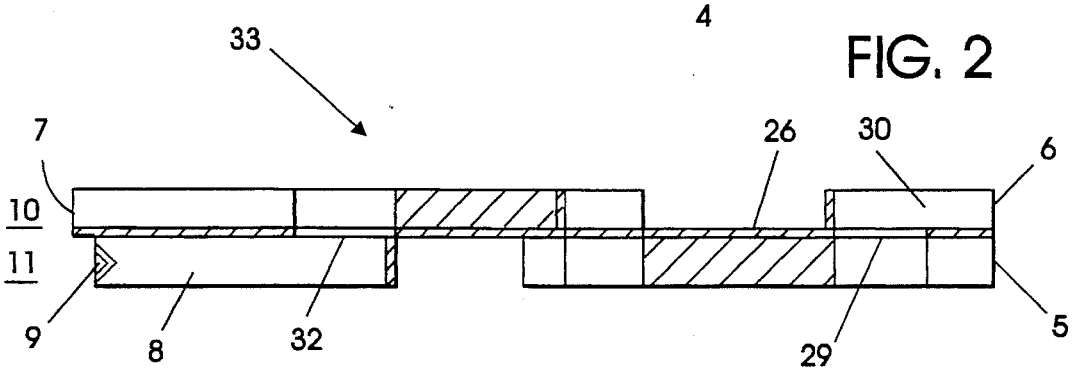
FIG. 2 shows a section along centre line II—II in FIG. 1.

FIG. 1 shows an embodiment of a device according to the invention seen from "above" while FIG. 2 shows a section along line II—II. The device, in future referenced as comparator, is provided with four inputs 1, 2, 3, 4.

The comparator also has four outputs 5, 6, 7, 8. One of these outputs, 8, is normally not used but is terminated with an attenuation device 9. Both inputs and outputs are designed for connection with wave-guides.

The comparator is formed in two parallel planes, a first, lower plane 11 and a second, upper plane 10- All inputs 1–4 and outputs 5 and 8 are placed in the lower plane 11 while the outputs 6 and 7 are placed in the upper plane 10.

Figure 3:
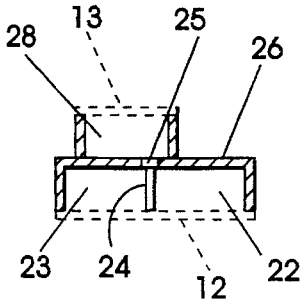
FIG. 3 shows a section along line III—III in FIG. 1.

To facilitate the understanding of the invention the upper plane 10 has in FIGS. 1 and 2 been shown as open towards the viewer. On the other hand, when the comparator is used in its normal application it is closed by means of a cover or other such device that covers the open upper and lower sides of the comparator. This is shown in greater detail in FIG. 3 which is a section along line III—III in FIG. 1. In FIG. 3 a lower and an upper cover, 12, 13 respectively, are indicated with dashed lines.

The comparator consists of four magic T:s 14, 15, 16, 17 of a special design. The function and design of the four magic T:s are the same but the following description will refer to the magic T 14. From its two inputs 1 and 2, two parallel input wave-guides 22 and 23 extend, separated by a partition wall 24. The length of the partition wall is less than that of the input wave-guides. Due to this, a common space for the input wave-guides will be formed. In this space a slot 25 is arranged in the dividing well 26 that separates the upper 10 and the lower plane 11. The longitudinal direction of the slot is parallel to the input wave-guides. Further away from the far end of the slot relative the inputs 1 and 2, the common space is terminated with a wall in which the output 27 is arranged. In the plane on top of the input wave-guides an upper wave-guide 28 is placed with its longitudinal direction parallel to that of the slot and placed asymmetrically such that the slot is located on one side of the centre line of the wave-guide along one of the long sides of the wave-guide. The end of the upper wave-guide directed towards the inputs is in association with the slot terminated with a wall, while the open end constitutes an output that by way of a wave-guide 21 leads to the magic T 17.

As is previously known from the theory of magic T:s, in the area around the slot 25 the signals that are fed to the inputs 1 and 2 will be brought together. Consequently a signal will appear at the output 27 ("summation output") that constitutes the sum of the signals supplied to the inputs 1 and 2. By means of dimensioning the length and width of the slot, its impedance can be adapted to the wave-guide in such a way that the slot will constitute a radiation element. Due to the asymmetric placement of the upper wave-guide 28 in relation to the radiating slot, it will excite the wave-guide. The slot thus constitutes a 10 coupling element that electrically connects the input wave-guides and the upper wave-guide. Since the slot is placed on the extension of the partition wall 24, the excited signal in the upper wave-guide will constitute the difference between the signals supplied to the inputs. The wave-guide 28 thus constitutes the "difference" output of the magic T.

The placement of the wave-guide 28 can also be such that its longitudinal direction forms an angle to the longitudinal direction of the slot. The impedance matching between slot and wave-guide can also in this case be made by adjustment of the dimensions of the slot and also by means of changing the location of the slot with respect to the terminating wall of the wave-guide 28.

It must be stressed that the function of the slot in the presently described magic T differ considerably from the conventional magic T where the difference output is constituted by a wave-guide port, i.e. an opening with the same dimensions as the cross section of the connecting wave-guide.

The four magic T:s are connected together in a symmetrical structure. Two of the magic T:s (14 and 16) are placed with their inputs 1 and 2 and 3 and 4, respectively and summation outputs 27 and 34 respectively in the lower plane with the outputs aligned towards each other. The summation outputs are connected to the two wave-guides 18 and 19 that are angled at 90° such that they become parallel. The parallel wave-guides are connected to the inputs of the third magic T 15, whose inputs and summation output 5 are consequently also placed in the lower plane.

The difference outputs of the magic T:s 14 and 16 are placed in the upper plane and there they are connected to two wave-guides 21, 20 respectively. These wave-guides are also angled at 90° but in the opposite direction compared to the wave-guides 18 and 19. The wave-guides 20 and 21 which are parallel are connected to the inputs of the magic T 17, whose summation output is consequently also therefore placed in the upper plane. By means of the-design of the wave-guides 18–21, the magic T:s will consequently have their inputs directed towards each other.

The difference output of the magic T 15 is placed in the upper plane, while the difference output of the magic T 17 is placed in the lower plane. As previously mentioned, this output is normally not used and due to this it is terminated with an attenuation device 9.

If four signals A, B, C and D are connected to the inputs 1, 2, 3 and 4 respectively, the signals A and B of the magic T 14 will be summed to A+B and, via the output 27 and wave-guide 18, fed to the magic T 15, while the signals C and D are summated in the magic T 16 and, via the wave-guide 19 also fed to the magic T 15. The wave-guides 18 and 19 constitute, in analogy with the previous description of the magic T 14, input wave-guides to the magic T 15. In this the signals A+B and C+D are summated whereby the signal A+B+C+D becomes available at the output 5.

In a corresponding manner, in the slot 29 of the magic T 15 a signal will appear that constitutes the difference between the signals in the wave-guides 18 and 19. The slot 29 will, due to this, excite the upper wave-guide with the signal (A+B)–(C+D) which will therefore become available at output 6 of the comparator.

Further, via the wave-guide 20 the signal D-C from the slot 31 of the magic T 16, as well as the signal A-B from the magic T 14 via the wave-guide 21, will be fed to the magic T 17. Since the wave-guides 20 and 21 constitute input wave-guides to the magic T 17, both the signal (A+D)–(B+C) which is available at tho output 7, as well as the signal (A–B)–(D–C), are formed therein. The latter signal has no significance in most applications and due to this the corresponding output 8 is terminated with an attenuator 9 in which the signal is blanked.

The manufacture of the comparator inclusive of the included magic T:s is simple. As is evident from the description the comparator comprises only three main parts, these being the comparator body 33 arranged in two planes 10 and 11, as well as the two cover 12 and 13 that cover the open sides of the comparator body. By means of its open construction on two sides, it is possible to manufacture the comparator in one piece, shaped from the open sides. Due to this, it is possible to attain high dimensional accuracy by means of utilizing numerically-controlled machines. This, in combination with the symmetrical construction apparent from FIG. 1, means that the requirements of equality between the electrical wave lengths between the comparator's summation and difference forming elements —the magic T:s —are considerably easier to fulfill compared with comparators put together with conventional magic T:s, wave-guides, wave-guide knees and bends etc.

The special design of the magic T:means that these require less space, especially in height, compared to conventional magic T:s. By means of the way in which the transfer between the two planes of the comparator is carried out, there are no requirements for any means for impedance matching in the wave-guides. The design of the magic T:s is one of the conditions for the design of the comparator so that it aquires a very compact-design without complicating the manufacture.

The described embodiment is especially suitable in a target tracking radar of the mono pulse type or a satellite tracking receiver system to be used to form the signals that are required for the control of the alignment of the antenna and for reception of the information-carrying signal.

The invention is not limited to the described embodiment, but may be varied freely within the scope of the appended claims.

What is claimed is:

1. A device for forming a first output signal as well as at least a second and a third output signal by bringing four input signals in the microwave range together, said first output signal being a sum of said input signals and said second and third output signals being differences between different combinations of said input signals, said device comprising wave-guide means arranged in a first plane and wave-guide means arranged in a second plane, said first and second planes being disposed parallel and next to each other;

said wave-guide means of said first plane comprising parallel input means to a first and a second magic T in which said four input signals are added in pairs forming pairwise added input signals;

said wave-guide means of said first plane further comprising a first wave-guide means for feeding said pairwise added input signals to input means of a third magic T where said pairwise added input signals are added to form said first output signal, and subtracted to form said second output signal;

whereby in said first and second magic T:s arranged in said first plane, said four input signals are subtracted in pairs forming pairwise subtracted input signals; and said wave-guide means of said first plane further comprising second wave-guide means arranged in said first plane and said wave-guide means of said second plane comprising third wave-guide means arranged in said second plane; and wherein said pairwise subtracted input signals are transferred from said second wave-guide means of said first plane to said third wave-guide means of said second plane whereby said pairwise subtracted input signals are fed to input means of a fourth magic T arranged in said second plane, in which said pairwise subtracted input signals are added to form said third output signal.

2. The device as claimed in claim 1, wherein said pairwise subtracted input signals are transferred from said second wave-guide means of said first plane to said third wave-guide means of said second plane by connection means in the form of slots, having a longitudinal direction, which excite said third wave-guide means of said second plane.

3. The device as claimed in claim 2, wherein said third wave-guide means of said second plane comprises a plurality of third wave-guides each with a longitudinal direction, each third wave-guide being associated with a respective one of said slots, and are arranged asymmetrically in relation to each said respective slot, and that the longitudinal direction of each said slot is parallel to the longitudinal direction of its respective said third wave-guide.

4. The device as claimed in claim 2, wherein said third wave-guide means of said second plane comprises a plurality of third waveguides each with a longitudinal direction, each third wave-guide being associated with a respective one of said slots, and the third wave-guides are arranged in relation to each said respective slot in such a way that the longitudinal direction of each said slot forms an angle to the longitudinal direction of its respective said third wave-guide.

5. The device as claimed in claim 1, wherein a fourth output signal is formed by said pairwise subtracted input signals transferred to said second plane which are subtracted and, via a further slot transferred to a fourth wave-guide arranged in said first plane, and said fourth wave-guide is terminated with an attenuation device.

6. The device as claimed in claim 1, comprising a comparator body on which on one side those said wave-guide means belonging to said first plane are arranged and on which, on the opposite side, those said wave-guide means belonging to said second plane are arranged, whereby three sides of each said wave-guide means are formed by said comparator body and the fourth side of each said wave-guide means is formed by covering means placed on opposite sides of said comparator body.

7. A magic T adapted for use in a device for forming a first output signal as well as at least a second and a third output signal by means of bringing four input signals in the microwave range together, said first output signal being a sum of said input signals and said second and third output signals being differences between different combinations of the input signals, the magic T comprising two inputs, comprising two parallel wave-guide means having an impedance and being of a predetermined length, a partition wall being of a predetermined length extending from said inputs, a first output means and a second output means, wherein:

said two parallel wave-guide means and said first output means are arranged in a first plane, separated from a second plane, parallel with said first plane, by a dividing wall;

said second output means is a third wave-guide means having a longitudinal direction, arranged in said second plane, whereby said third wave-guide means is electrically connected to said two parallel wave-guide means by, in said dividing wall, a slot having a longitudinal direction.

8. A magic T as claimed in claim 7, wherein said length of said partition wall is less than said length of said two parallel wave-guide means whereby a common space for said two parallel wave-guide means is formed, which common space is limited by a wave-guide wall extending perpendicular to the longitudinal direction of said partition wall and in which wave-guide wall said first output means is arranged;

said slot is arranged in said dividing wall in said common space for said two parallel wave-guide means.

9. A magic T as claimed in claim 8, wherein said third wave-guide means is asymmetrically placed with respect to said slot and the longitudinal direction of said third wave-guide is parallel to the longitudinal direction of said slot.

10. A magic T as claimed in claim 8, wherein said third wave-guide means is placed with respect to said slot so that the longitudinal direction of said third wave-guide forms an angle to the longitudinal direction of said slot.

11. A magic T as claimed in claim 7, wherein said slot is placed on an imaginary extension of said partition wall and by its shape, is adapted to the impedances of said two parallel wave-guide means.

* * * * *